US011878384B2

(12) United States Patent
Eisenmann

(10) Patent No.: US 11,878,384 B2
(45) Date of Patent: Jan. 23, 2024

(54) PORTABLE POWER TOOL HAVING A COVERING DEVICE

(71) Applicant: Festool GmbH, Wendlingen (DE)

(72) Inventor: Philipp Eisenmann, Unterensingen (DE)

(73) Assignee: Festool GmbH, Wendlingen (DE)

( * ) Notice: Subject to any disclaimer, the term of this patent is extended or adjusted under 35 U.S.C. 154(b) by 854 days.

(21) Appl. No.: 16/089,733

(22) PCT Filed: Apr. 10, 2017

(86) PCT No.: PCT/EP2017/058585
§ 371 (c)(1),
(2) Date: Sep. 28, 2018

(87) PCT Pub. No.: WO2017/178443
PCT Pub. Date: Oct. 19, 2017

(65) Prior Publication Data

US 2019/0118329 A1 Apr. 25, 2019

(30) Foreign Application Priority Data

Apr. 13, 2016 (DE) ..... 10 2016 106 782.2

(51) Int. Cl.
*B24B 23/04* (2006.01)
*B24B 23/00* (2006.01)
(Continued)

(52) U.S. Cl.
CPC ..... *B24B 23/046* (2013.01); *B24B 23/005* (2013.01); *B24B 23/02* (2013.01); *B24B 23/04* (2013.01); *B24B 55/05* (2013.01)

(58) Field of Classification Search
CPC ..... B24B 23/02; B24B 23/028; B24B 23/045; B24B 23/005; B24B 23/04; B24B 23/03;
(Continued)

(56) References Cited

U.S. PATENT DOCUMENTS 3,345,784 A * 10/1967 Stelljes ..... B24B 23/04 D8/62
3,716,917 A * 2/1973 Ruben ..... B24B 23/02 30/391
(Continued)

FOREIGN PATENT DOCUMENTS

CN 1792568 A 6/2006
CN 204295449 A 4/2015
(Continued)

OTHER PUBLICATIONS

Festool, DE-202005009030-U1 machine translation, Aug. 25, 2005 (Year: 2005).*
(Continued)

*Primary Examiner* — Brian D Keller
*Assistant Examiner* — Marcel T Dion
(74) *Attorney, Agent, or Firm* — Hoffmann & Baron, LLP

(57) ABSTRACT

A portable power tool having a plate tool (30), in particular a sanding plate or polishing plate, and a drive motor, arranged in a machine housing, for driving the plate tool into an oscillating and/or rotating and/or eccentric movement of a machining surface of the plate tool, wherein the portable power tool is able to be guided with the machining surface in a main working direction forwards and to the side transversely to the main working direction in at least one transverse working direction in order to sand or polish a workpiece surface, wherein the portable power tool has a covering device for the plate tool, said covering device having at least one protective wall which is disposed upstream of at least one lateral surface, extending next to the machining surface, of the plate tool with regard to the main working direction and/or the transverse working direction in order to protect against contact with obstacles.

35 Claims, 3 Drawing Sheets

(51) Int. Cl.
*B24B 55/05* (2006.01)
*B24B 23/02* (2006.01)

(58) Field of Classification Search
CPC ..... B24B 55/05; B24B 55/052; B24B 55/055; B24B 23/046
USPC ..... 451/357–359, 451, 457
See application file for complete search history.

(56) References Cited

U.S. PATENT DOCUMENTS 3,824,745 A * 7/1974 Hutchins ..... B24B 55/102 451/359
3,826,045 A * 7/1974 Champayne ..... B24B 55/102 451/359
3,882,644 A * 5/1975 Cusumano ..... B24B 55/102 451/359
4,414,782 A * 11/1983 Langenberg ..... B24B 23/04 451/350
4,697,389 A * 10/1987 Romine ..... B24D 15/02 451/354
4,905,421 A * 3/1990 Maier ..... B24B 23/02 451/359
4,920,702 A * 5/1990 Kloss ..... B24D 9/08 15/97.1
6,887,141 B1 * 5/2005 Lin ..... B24B 23/00 451/356
8,137,165 B2 * 3/2012 Loveless ..... B24B 55/102 451/456
2002/0016143 A1 * 2/2002 Bosten ..... B24B 55/105 451/344
2004/0224621 A1 * 11/2004 Fraser ..... B25F 5/02 451/359
2005/0079808 A1 * 4/2005 Tiede ..... B24B 23/04 451/357
2006/0052041 A1 3/2006 Wiker
2006/0141915 A1 6/2006 Walstrum et al.
2008/0022537 A1 * 1/2008 Clarke ..... B23D 57/0076 30/390
2008/0280549 A1 * 11/2008 Sulea ..... B24B 23/02 451/451
2009/0186559 A1 * 7/2009 Loveless ..... B24B 55/10 451/28
2009/0197515 A1 * 8/2009 Wang ..... B24B 55/052 451/451
2009/0229436 A1 * 9/2009 Crain ..... B27B 9/02 83/373
2011/0021121 A1 * 1/2011 Loveless ..... B24B 23/028 451/456
2011/0159789 A1 * 6/2011 Park ..... B24B 45/006 451/344
2011/0275293 A1 * 11/2011 Eto ..... B24B 55/05 451/453
2011/0318999 A1 * 12/2011 Boeck ..... B23Q 11/08 451/344
2012/0190280 A1 * 7/2012 Esenwein ..... B24B 55/052 451/452
2012/0252328 A1 * 10/2012 Muto ..... B24B 23/022 451/453
2013/0000935 A1 1/2013 Kelleher et al.
2014/0273771 A1 * 9/2014 Kuehne ..... B24B 23/04 451/344
2014/0342645 A1 * 11/2014 Tagscherer ..... B24B 55/052 451/451
2015/0056896 A1 * 2/2015 Chen ..... B24B 55/05 451/357
2016/0297052 A1 * 10/2016 Aiken ..... B24B 55/04
2017/0072535 A1 * 3/2017 Iwakami ..... B24B 23/028
2019/0283210 A1 * 9/2019 Tuckner ..... B24B 55/052

FOREIGN PATENT DOCUMENTS

CN 204295449 U 4/2015
DE 202005009030 U1 8/2005
DE 202005009030 U1 * 9/2005 ..... B24B 55/05
DE 202007013705 2/2009
DE 102008059585 7/2010
DE 102010033602 2/2012
DE 20 2006 021 278 U1 9/2014
EP 1714739 10/2006
EP 1714739 A1 10/2006
EP 2186600 A1 5/2010
EP 3042738 A2 7/2016
JP 09103959 A 4/1997
JP 9192977 A 7/1997
JP 2005288566 A 10/2005
JP 4146819 B2 6/2008
JP 4146819 B2 9/2008
KR 10-0882805 B1 2/2009
WO WO2014086866 6/2014

OTHER PUBLICATIONS

Search Report of the German Patent and Trademark Office, 10 pages.
Japanese Office Action dated Jul. 12, 2022.

* cited by examiner

PORTABLE POWER TOOL HAVING A COVERING DEVICE

This application claims priority based on an International Application filed under the Patent Cooperation Treaty, PCT/EP2017/058585, filed Apr. 10, 2017, which claims priority to DE 10 2016 106 782.2, filed Apr. 13, 2016.

BACKGROUND OF THE INVENTION

The invention relates to a portable machine tool having a disc tool, in particular a grinding disc or polishing disc, and a drive motor which is arranged in a machine housing for driving the disc tool to produce an oscillating and/or rotating and/or eccentric movement of a processing face of the disc tool, wherein the portable machine tool can be guided with the processing face forwards in a main working direction and laterally transversely relative to the main working direction in at least one transverse working direction for a grinding or polishing operation of a workpiece surface, wherein the portable machine tool has for the disc tool a covering device which has at least one protection wall which is arranged upstream of at least one side face of the disc tool which extends beside the processing face with respect to the main working direction and/or the at least one transverse working direction in order to protect against contact with obstacles.

Such a covering device according, for example, to DE 20 2005 009 030 A1 is provided by the Applicant, for example, as a plug-in component which can be fitted when required onto the machine housing and which then covers the side faces of the disc tool in the main working direction and the at least one transverse working direction. The disc tool then does not strike obstacles with the side faces thereof, but is instead covered by the protection wall of the covering device. The side faces can then no longer damage, for example, obstacles, in particular the workpiece itself, for example, by means of impact loading, by abrasion or the like, on the other hand, the generally sensitive side faces of the disc tool are also protected. This is because the disc tool generally comprises a cushion or pad on which a grinding means or polishing means is arranged. Consequently, the protection wall protects both the disc tool and the workpiece. However, if the disc tool is required for an edge-side processing of the workpiece surface, the operator has to remove the covering device again, which is laborious.

SUMMARY OF THE INVENTION

An object of the present invention is therefore to provide an improved portable machine tool with a covering device for the disc tool thereof.

In order to achieve the object, with a portable machine tool of the type mentioned in the introduction, there is provision for the at least one protection wall to have with respect to the main working direction and/or the at least one transverse working direction at least one recess through which the disc tool protrudes with a side edge region freely in front of an outer peripheral contour of the covering device in the region of the processing face so that an edge portion or corner region of the processing face of the disc tool, which portion or region extends as far as the side edge region, is ready in a state unimpeded by the at least one protection wall for an edge-side processing operation of the workpiece surface.

The approach according to the invention thus makes provision for the at least one protection wall per se to cover and protect the at least one side face of the disc tool, but nonetheless to provide for processing in the main working direction and/or at least one transverse working direction a recess through which the disc tool in a manner of speaking projects from the covering device or protrudes through the covering device so that the protruding side edge region of the disc tool and consequently the processing face at this side edge region is ready for an edge-side processing operation of the workpiece surface. The disc tool with the protruding side edge region may thus be guided carefully by the user, for example, as far as a skirting board, side wall or the like, in order to also process the workpiece surface in an abrasive manner, polishing manner or the like at that location. In this instance, other portions of the side face or side faces of the disc tool or portions are effectively covered by the covering device in the main working direction and/or the at least one transverse working direction so that the portable machine tool and the disc tool thereof with respect to the portions of the side face or side faces of the disc tool covered by the at least one protection wall of the covering device can be guided towards obstacles without the disc tool coming into contact with the obstacle with the side face thereof. This is because the protection wall protects the disc tool at that location.

The processing face protrudes, for example, in the region of the at least one recess beyond a projection of the covering device onto the workpiece surface.

It can also be said that the processing face of the disc tool in the region of the at least one recess protrudes in front of a notional connection line between mutually opposing end sides of the protection wall at the recess.

In place of or in addition to the definition "through which the disc tool protrudes with a side edge region freely in front of an outer peripheral contour of the covering device in the region of the processing face", it is also possible to say: "through which the disc tool protrudes with a side edge region freely in front of an envelope of the covering device in the region of the processing face". The envelope is an envelope in the sense of a geometric envelope.

The at least one recess is, for example, a U-shaped or V-shaped cut-out from the at least one protection wall or comprises such a cut-out.

Only a single recess may be provided in the at least one protection wall. However, it is also possible for a plurality of recesses which are arranged beside each other in a row direction to be provided. The recesses may, for example, have a saw-tooth-like structure. It is also possible for the recesses to be defined by a wave-like contour. Furthermore, the recesses may be provided between tooth-like, in particular rectangular tooth-like, portions of the at least one protection wall or the protection wall as a whole.

The covering device may form a covering hood which at least partially covers the disc tool at a side which is opposite the processing face.

The portable machine tool could also be referred to as a polishing machine or grinding machine. Since it is possible to provide different disc tools on the portable machine tool, that is to say, grinding tools or polishing tools or at least corresponding processing faces on the disc tools, the portable machine tool can be used for grinding or polishing. If the disc tool or the processing surface thereof can be replaced, the portable machine tool can advantageously be retrofitted both for grinding and for polishing.

The drive motor is, for example, an electric motor or a pneumatic motor. For example, the portable machine tool can be driven with electrical energy or pneumatic energy or compressed air. Preferably, the portable machine tool has an interface for a mobile electrical energy store, in particular a battery pack. However, the machine tool may also be line-operated, that is to say, it has at least one network interface for connection to an electrical or pneumatic supply network.

The disc tool is preferably plate-like.

Advantageously, the disc tool or the portable machine tool has a carrier plate. The carrier plate is advantageously substantially torsion-resistant and/or comprises metal and/or plastics material. The carrier plate may have a ribbing or other reinforcement structure. The carrier plate may be securely connected to an output of the drive motor or a gear mechanism which is driven by the drive motor. The carrier plate may even form the output of the gear mechanism or drive motor. Alternatively, it is possible for the carrier plate to be able to be releasably connected to such an output of a gear mechanism or the drive motor. The carrier plate advantageously has, for example, a retention face which corresponds to the processing face for a grinding means or polishing means, for example, an abrasive paper, a polishing or knitted grinding fabric or the like. A cushion or pad for a grinding means or polishing means may also be provided on the carrier plate.

The disc tool or a carrier plate for the disc tool advantageously has a cushion or a pad. Advantageously, there is arranged on the cushion or pad an adhesive layer or hook and loop layer for fitting a grinding means or polishing means, for example, an abrasive paper, a grinding pad, a polishing means, or the like. Consequently, this can be readily replaced in the event of wear. It is also possible for the cushion or pad to have polishing means, grinding means, or the like, integrally on the operating face thereof.

It is advantageous for the at least one protection wall of the covering device to extend as far as the processing face. Consequently, it is advantageous for only the operating face or a narrow region above the operating face, for example, of approximately 1 mm, 2 mm or 3 mm, to protrude freely in front of the protection wall of the covering device.

There is preferably provision for the at least one protection wall of the covering device to completely or substantially cover side flanks of the disc tool as far as the processing face.

It is also advantageous for the at least one protection wall of the covering device to completely or substantially cover a cushion or pad of the disc tool which is provided for or has a grinding means or polishing means, for example, an abrasive paper.

The disc tool may at least partially form a fixed component of the portable machine tool. Consequently, for example, the carrier plate and/or the cushion or pad may be securely connected to the portable machine tool, for example, screwed, adhesively bonded or the like.

However, it is also possible for the disc tool to be able to be releasably secured to a tool receiving member of the portable machine tool. Consequently, the disc tool can be readily replaced in the event of wear or if another disc tool is required. On the tool receiving member, for example, bayonet contours, screw means, plug-in contours or the like for releasably securing the disc tool to the tool receiving member are provided. The disc tool has corresponding counter-contours, for example, bayonet counter-contours, a through-opening for a screw, etcetera.

An advantageous concept makes provision for the disc tool to protrude freely counter to the main working direction backwards through a free portion of the covering device. Consequently, there is therefore provision for the protection wall or the protection walls to cover the disc tool laterally with respect to the main working direction and preferably also with respect to the at least one transverse working direction, but not towards the rear. Consequently, a relatively extensive rear edge region of the processing face of the disc tool in the manner explained in the introduction is available where necessary for an edge-side processing operation of the workpiece surface. There is in addition the edge-side portion of the processing face which protrudes through the at least one recess in the at least one protection wall of the covering device.

It is also advantageous for the covering device not to cover or not to completely cover a rear portion of the disc tool with respect to the main working direction, for example, the rear end side thereof, rear narrow side or the like.

It is preferable for the covering device not to cover the disc tool at the rear transversely relative to the main working direction, in particular over the entire transverse width thereof transversely relative to the main working direction. A disc tool which has, for example, a rectangular processing face is in this embodiment at the rear transverse narrow side or transverse end side thereof not covered by the covering device. With a disc tool having a substantially triangular processing face, for example, a triangular member which is arranged at the rear in the working direction, is not covered by the covering device.

It is further possible for a rear portion of the machine housing with respect to the main working direction, in particular a handle portion, and/or a suction connection for dusty air to protrude to the rear over the processing face of the disc tool counter to the main working direction. Even when this rear portion or, for example, an extraction pipe for dusty air which can be connected to a suction hose, impedes or prevents an edge-side use of the processing face of the disc tool, the at least one recess provided according to the invention ensures that the end portion or corner region of the processing face which protrudes through the protection wall is still available for edge-side processing of the workpiece surface.

The covering device may in one embodiment of the invention be a fixed component of the portable machine tool. For example, it is integrally or securely connected to the machine housing.

Advantageously, there is provision for the covering device to be able to be released from the portable machine tool or from the machine housing as required.

Preferably, there is provision for the covering device to be able to be secured to the machine housing in a tool-free manner and/or removed from the machine housing in a tool-free manner.

Preferably, there is provision for the covering device to be able to be releasably secured to the machine housing using securing means. The securing means may, for example, comprise locking means and/or clamping means and/or at least one plug-type receiving member. The securing means may also readily comprise a detent and/or a clamp and/or a screw or the like. If the covering device is removed from the machine housing, the disc tool is preferably completely free at the outer periphery thereof, that is to say that the outer peripheral region or lateral edge region or the disc tool as a whole is without a cover. Consequently, the disc tool can with the entire side edge region or outer peripheral region thereof be guided towards edge regions of the workpiece surface adjacent to obstacles.

A preferred embodiment makes provision for the securing means to comprise a plug-type receiving member on the machine housing for fitting the covering device.

Advantageously, the plug-type receiving member comprises a plug guide or plug contours which guide and/or retain the covering device in a positive-locking manner transversely relative to a plug direction along which it can be fitted to the machine housing.

It is preferable for the covering device to be able to be locked to the machine housing using locking means or a locking device. The locking device comprises, for example, at least one locking projection and at least one locking receiving member in which the at least one locking projection engages in a locking position.

For example, there is provision for the covering device to be constructed in the manner of a brace or clamp whose lateral members surround the machine housing at mutually opposing sides. These mutually opposing sides are, for example, associated with the at least one transverse working direction. Preferably, a base member of the brace or clamp is in abutment with a front side of the machine housing facing the main working direction when the brace or clamp is secured to the machine housing.

The side members of the clamp or brace advantageously have locking means, for example, locking projections or locking receiving members which are provided for engagement with the machine housing. Complementary locking means, that is to say, locking receiving members or locking projections, are advantageously provided on the machine housing. Advantageously, the locking means are provided at free end regions of the lateral members of the covering device.

The clamp forms, for example, a clamping means.

Lateral members of the clamp advantageously have a tension towards each other and can be widened or redirected away from each other in order to be secured to the machine housing.

It is preferable for the lateral members of the clamp or brace to be able to be redirected away from each other in order to be secured to the machine housing. The clamp or brace can so-to-speak be widened so that it can be secured to the machine housing. The lateral members are then preferably resiliently preloaded and/or have a tension towards each other so that, for example, the above-mentioned catch means, in particular at free end regions of the lateral members, can move into locking engagement with complementary locking means of the machine housing. Of course, the locking is particularly in this embodiment not absolutely necessary. In particular, it is possible for the clamp to be retained on the machine housing, for example, in a clamping seat.

Advantageously, on a base member of the covering device, at least one positive-locking contour is provided for positive-locking engagement with a positive-locking counter-contour of the machine housing. The positive-locking contour serves, for example, to mount the covering device on the machine housing in a correct manner in terms of rotation angle. The positive-locking contour may also constitute an encoding so that only a covering device which fits the machine housing can be secured to the machine housing. On the machine housing, a corresponding receiving encoding formed by the positive-locking counter-contour is then provided for the encoding of the covering device.

The disc tool may, for example, have a polygonal processing face. For example, the processing face is substantially triangular or rectangular. In particular, the portable machine tool may be a so-called rectangular grinder or triangular grinder, at least when it is provided with the corresponding grinding disc or polishing disc or other disc tool with the above-mentioned triangular processing face. At this point, it should be mentioned that a disc tool with a substantially triangular processing face may also have round or rounded outer edges.

Of course, however, the invention can also readily be used with round, in particular circular, disc tools. The disc tool or the processing face thereof or both may, for example, be circular, elliptical, oval or the like.

The geometry of the envelope or outer peripheral contour of the covering device in the region of the processing face, with the exception of in the region of the at least one recess, advantageously corresponds approximately to the geometry of the outer peripheral contour of the processing face. Consequently, the envelope or outer peripheral contour of the covering device with a triangular disc tool or a triangular processing face is advantageously also triangular, with a round processing face also round, in particular circular, elliptical or oval, and with a rectangular processing face advantageously also rectangular.

Advantageously, there is provision between the drive motor and the disc tool for a gear mechanism for producing an eccentric and/or oscillating and/or hypercycloid and/or rotating drive movement of the disc tool to be arranged, wherein the gear mechanism can advantageously be switched between at least two of the above-mentioned movement types.

With round or circular disc tools, it is advantageous for these to be able to be driven in a rotational or rotary manner by the drive motor. The rotating movement may be a movement which rotates exclusively about an axis. However, a hypercycloid rotation movement is also possible, that is to say, superimposed rotation movements of the disc tool.

With disc tools which are not circular, however, it is advantageous for these not to be able to be rotated or for the rotation movement to be laterally limited. For example, the portable machine tool has at least one rotary stop which laterally limits a rotation movement of the disc tool. The rotary stop may, for example, be a component of the gear mechanism or a separate device.

The non-circular disc tools, in particular polygonal disc tools, can advantageously be driven in an eccentric and/or oscillating manner by the drive motor using the gear mechanism which is arranged between the drive motor and the disc tool. Advantageously, the gear mechanism can be switched so that it can be switched between at least two movement types, for example, from an eccentric operation to a rotation operation or the like.

Advantageously, there is provision for the at least one protection wall to cover the disc tool with respect to the main working direction or to be arranged frontally upstream of the disc tool. The operator can thus work forwards, that is to say, in the main working direction, in a manner of speaking in an unimpeded manner since at that location the at least one protection wall where applicable strikes an obstacle which is in front of the portable machine tool, whilst the at least one recess is provided to the side thereof.

It is also possible for the disc tool to have only an outer peripheral contour or surface geometry which is polygonal and/or not suitable for a rotational movement through more than 30°, in particular more than 40°. Nonetheless, it is possible, for example, for a corner region of the processing face to be received in the at least one recess, in particular so as to be able to be moved in an oscillating manner.

With respect to the main working direction, the at least one protection wall or a portion thereof advantageously forms the foremost or front portion of the portable machine tool. Consequently, where applicable, the protection wall strikes an obstacle which is located head-on at the front in front of the portable machine tool with respect to the main working direction.

In a state head-on at the front with respect to the main working direction, therefore, a portion of the protection wall or the protection wall as a whole is advantageously provided. Laterally beside this portion of the protection wall at least a corner region of the processing face advantageously protrudes through the at least one recess in front of the outer peripheral contour of the covering device. Consequently, so to speak with respect to the main working direction, a portion of the processing face which is directed forwards is available for edge-side processing of the workpiece surface.

The corner region advantageously has at least one side edge which extends at right-angles transversely with respect to the main working direction. For example, the processing face is rectangular and a front side face of the processing face extends transversely with respect to the main working direction. This front side edge is covered by at least one portion of the protection wall and is not covered at least at one side.

An arrangement is particularly preferred in which, in addition to the portion of the protection wall which frontally covers in the main working direction, a corner region of the processing face protrudes in each case. The protection wall is thus arranged between recesses through which a corner region of the processing face protrudes in each case.

However, it is also possible in the main working direction so to speak for a corner or a tip of the processing face to protrude forwards through the at least one recess of the covering device. Laterally beside the corner or tip, the at least one protection wall extends and protects the side face of the disc tool. For example, the processing face is triangular and a front corner region of the processing face protrudes in the manner of a tip or corner. The operator must, for example, only in the case of movements in the main working direction, exercise a degree of caution so that the side face of the disc tool does not strike obstacles whilst transversely relative to the main working direction, in at least one transverse working direction, the protection wall or portions of the protection wall cover and consequently protect the disc tool.

Preferably, there is also provision for the machine housing not to impede work in the direction of the main working direction or the at least one transverse working direction or both, for example, by it not protruding in front of an outer peripheral contour of the covering device and/or the processing face of the disc tool. The machine housing thus does not strike obstacles in the event of movements of the portable machine tool in the direction of the main working direction or the at least one transverse working direction. The disc tool and the covering device protrude in the main working direction and/or the at least one transverse working direction in front of the machine housing or a projection of the machine housing onto the workpiece surface or the processing face. Consequently, the covering device forms besides the at least one recess in a manner of speaking the front side of the portable machine tool in the region of the processing face, whilst in the at least one recess the disc tool with the side edge region thereof forms in a manner of speaking the frontally outer region of the portable machine tool.

The machine housing may, for example, have a handle portion. It is preferable for a handle element to be securely connected to or integral with the machine housing. For example, the handle portion or the handle element is intended to be gripped by a hand of the operator. The handle portion or the handle element advantageously has a wrist support.

Alternatively, however, it is also possible for an in particular rod-like handle element to be supported in an articulated manner with the machine housing using an articulation arrangement, for example, an articulation arrangement having one or more pivot bearings. Consequently, the machine housing may, for example, using the articulation arrangement pivot relative to the handle element about one or more pivot axes. In particular, the portable machine tool may be a wall grinder or a ceiling grinder.

The covering device advantageously has one or more through-openings. The through-openings may be arranged beside each other in one or more row-like arrangement(s). It is particularly preferable for at least one through-opening in each case or a row-like arrangement of at least two through-openings to be arranged at longitudinal sides of the covering device, in particular parallel with the main working direction or at a small angle obliquely relative to the main working direction. Preferably, the at least one through-opening is arranged at an upper side of the covering device.

Through the at least one through-opening, it is possible to see, for example, the disc tool, in particular the carrier plate thereof. The carrier plate or the disc tool can in particular be seen from above through the covering device.

The at least one through-opening may also serve to allow external air to flow into the region of the disc tool. The external air can preferably be extracted at an extraction connection of the portable machine tool.

BRIEF DESCRIPTION OF THE DRAWINGS

An embodiment of the invention is explained below with reference to the drawings, in which.

DETAILED DESCRIPTION

Figure 1:
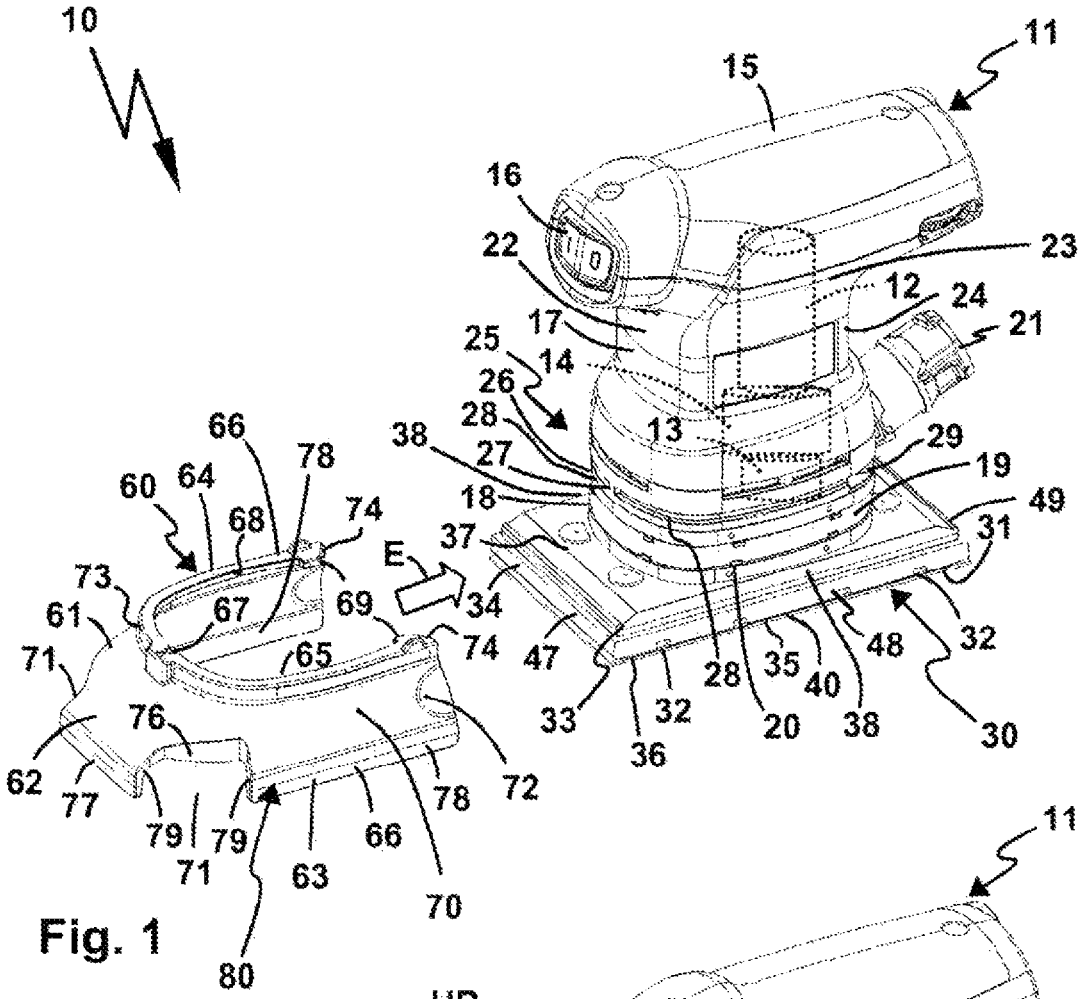
FIG. 1 is a perspective oblique view of a portable machine tool and an associated covering device in the state separated from each other.
Figure 2:
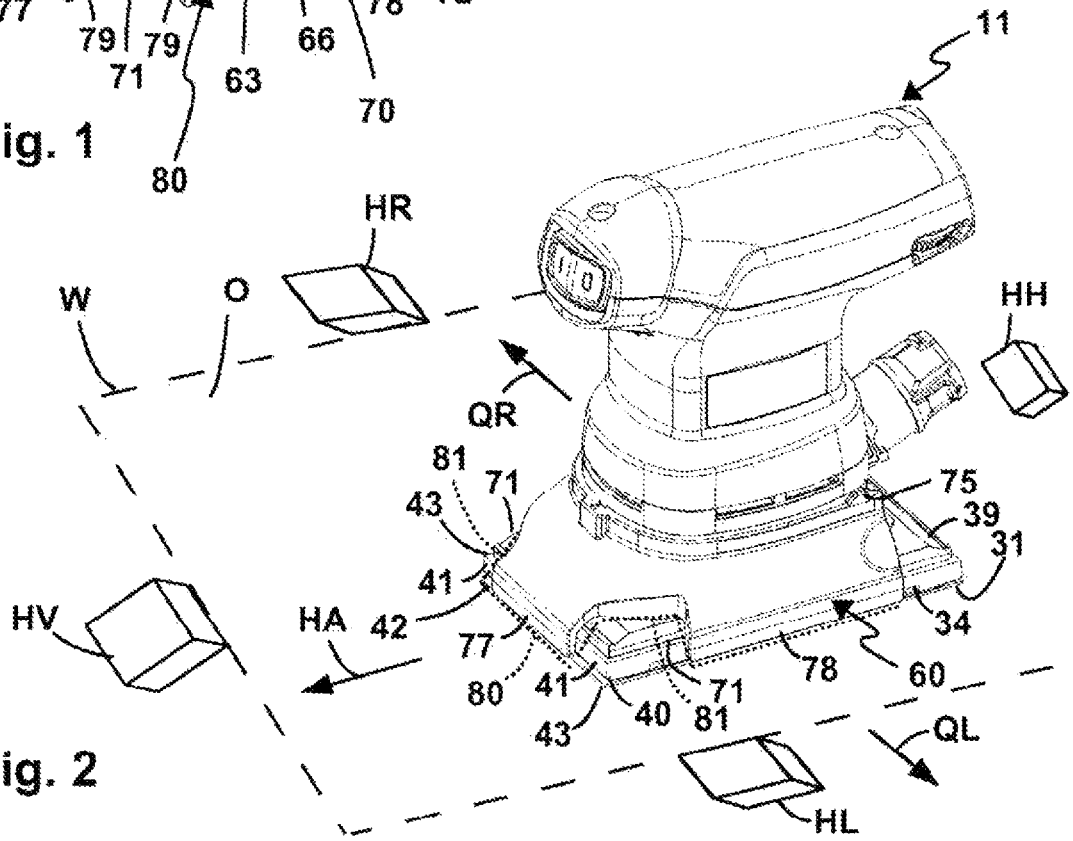
FIG. 2 shows the portable machine tool according to FIG. 1 with the covering device arranged thereon.

A portable machine tool 10 according to the drawing has a machine housing 11 in which a drive motor 12 for driving a disc tool 30 is arranged. A gear mechanism 14, for example, an eccentric gear mechanism for producing a hypercycloid movement of the disc tool 30 relative to the machine housing 11 or the like may be provided between the drive motor 12 and the disc tool 30. The disc tool 30 is, for example, arranged on an output 13 of the gear 14. The gear mechanism 14 may also bring about a speed reduction or other speed change between the output of the drive motor 12 and the output 13 thereof.

The machine housing 11 may be gripped using a handle portion 15, for example, enclosed with a hand, wherein at a front region of the handle portion 15 a drive switch 16 for switching on and switching off the drive motor 12 is provided.

Alternatively, however, it is also possible for an in particular rod-like handle element 15*a* to be supported in an articulated manner with the machine housing 11 using an articulation arrangement, for example, an articulation arrangement having one or more pivot bearings 111. Consequently, the machine housing may, for example, using the articulation arrangement pivot relative to the handle element about one or more pivot axes. In particular, the portable machine tool may be a wall grinder or a ceiling grinder.

The drive motor 12 itself is in turn arranged in a drive portion 17 of the machine housing 11. The disc tool 30 is arranged at a base region 18 of the machine housing 11 remote from the handle portion 15, in the drawing at the bottom on the drive portion 17. With a processing face 31 of the disc tool 30, a workpiece surface O of a workpiece W can be processed, for example, in the context of a grinding processing operation or a polishing processing operation. The operator may, for example, grip the portable machine tool 10 on the handle portion 15 and thus guide the disc tool 30 with the processing face 31 thereof over the workpiece surface O, for example, directly forwards in a main working direction HA or also transversely to the side with respect to the main operating direction HA to the right in a transverse working direction QR and to the left in a transverse working direction QL. In this instance, for example, circular movements on the workpiece surface O are also readily possible.

On the processing face 31, a processing surface may be provided integrally, for example, a coating with a corresponding granulation, an abrasive web or the like. However, preferably in the region of the processing face 31, a retention means, for example, a hook and loop retention means, an adhesive layer or the like, is provided in order to retain a grinding sheet or another grinding means 40, for example, a knitted grinding fabric which then provides the actual processing face 31. The processing face 31 may thus be formed by a replaceable grinding means or polishing means. Using the grinding means 40, the workpiece surface O may, for example, be ground. Alternatively, a polishing disc or similar other polishing means, for example, a knitted polishing fabric, would also be readily possible.

In the region of the output 13 or above the carrier plate 33, within the machine housing 11 there is provided an extraction chamber 19 which cannot be seen in the drawing and which is connected in terms of flow to an extraction connection 21 of the machine housing 11. Via the extraction connection 21, dust or other similar particles produced by a workpiece processing operation can be extracted from the region of the disc tool 30 which has for this purpose, for example, lateral influx openings 32 and influx openings which communicate with the lower side thereof (schematically illustrated).

In this instance, the disc tool 30 is at least partially securely connected to the output 13, that is to say, to a carrier plate 33. However, it would also be possible for the output 12 to have a tool receiving member, for example, with bayonet contours, a screw receiving member or the like, to which the carrier plate 33 can be releasably secured.

On a retention face 35 of the carrier plate 33, a cushion 34, for example, a pad, is arranged. The cushion comprises resilient material, for example, foam, rubber or the like. The cushion 34 is, for example, screwed, adhesively bonded or securely connected in some other manner to the carrier plate 33, but preferably so as to be able to be replaced. The grinding means 40 in contrast may be releasably secured to a securing face 36 of the cushion 34 which, for example, has hook and loop connection means or the like, that is to say, can be readily replaced in the event of wear or another quality requirement.

The disc tool 30 protrudes forwards with a portion 37 with respect to the main working direction HA, with portions 38 to the side with respect to the transverse working directions QR and QL and with a portion 39 to the rear counter to the main working direction HA in front of an outer peripheral contour 20 of the machine housing in the region of the disc tool 30. Consequently, the disc tool 30 is in a manner of speaking exposed, which in the state of the portable machine tool 10 illustrated in FIG. 1 facilitates edge-side processing of the workpiece surface O. The portion 37 protrudes, for example, in front of a front side 22 of the machine housing 11, the portions 38 project to the side, in front of transverse sides 23 of the machine housing 11. Although the rear portion 38 is to a degree protected by the extraction connection 21, it nonetheless protrudes in front of a rear side 24 of the machine housing 11.

In the so-to-speak uncovered state illustrated in FIG. 1, the disc tool 30 can be guided with the processing face 31 thereof in the main working direction HA forwards as far as an obstacle HV which protrudes in front of the workpiece surface O until it strikes the obstacle HV with the front side face 47 thereof. Also to the side, in the transverse working directions QR and QL, the disc tool 30 can be guided towards such obstacles HR or HL until it strikes this obstacle HR or HL with the lateral side faces 48 thereof. Even towards the rear, that is to say, counter to the main working direction HA, an edge-side processing is readily possible so that the processing face 31 can be guided until the disc tool 30 strikes with a rear side face 49 an obstacle HH which protrudes in front of the workpiece surface O, for example, a skirting board or the like.

However, the operator will generally wish to prevent such a collision in order not to damage the sensitive side flanks of the disc tool 30 and the obstacles themselves. This is because it can be seen that the resilient cushion 34 and also the narrow sides of the grinding means 40 are sensitive and can become damaged when striking such an obstacle HV, HR or HL. Furthermore, it is also possible for the narrow sides of the carrier plate 33 which preferably comprise a rigid material, in particular a hard plastics material, metal, to be able to damage the obstacle HV, HR or HL. In addition, the processing face 31 of the disc tool 30 has a polygonal, in this instance rectangular structure, wherein straight corner regions 41 of the disc tool 30 which have corners 43 or outer corners with respect to the main working direction HA and the transverse working directions QR and QL, are exposed and consequently particularly at risk of striking obstacles.

Figure 3:
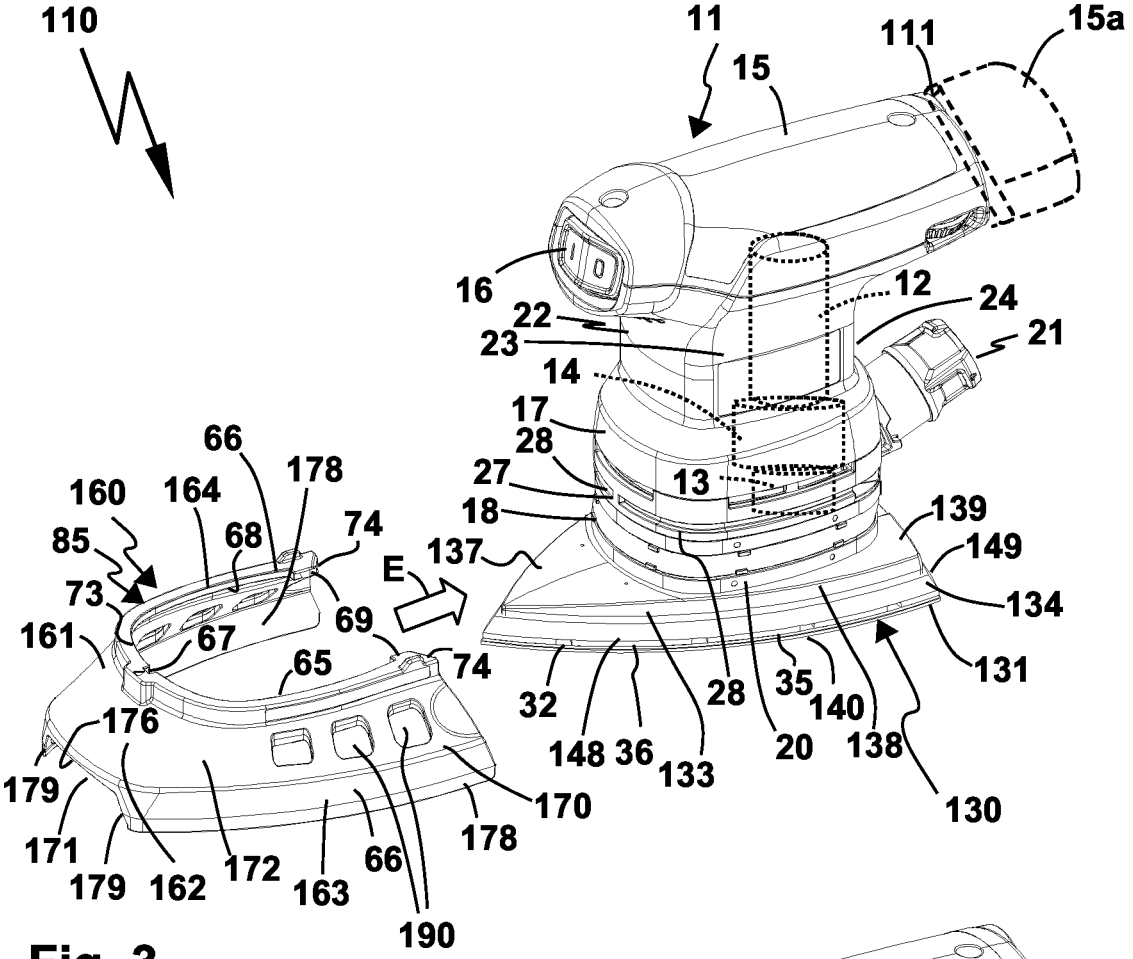
FIG. 3 shows the portable machine tool according to the above Figures with a different covering device in a state separated from each other.
Figure 4:
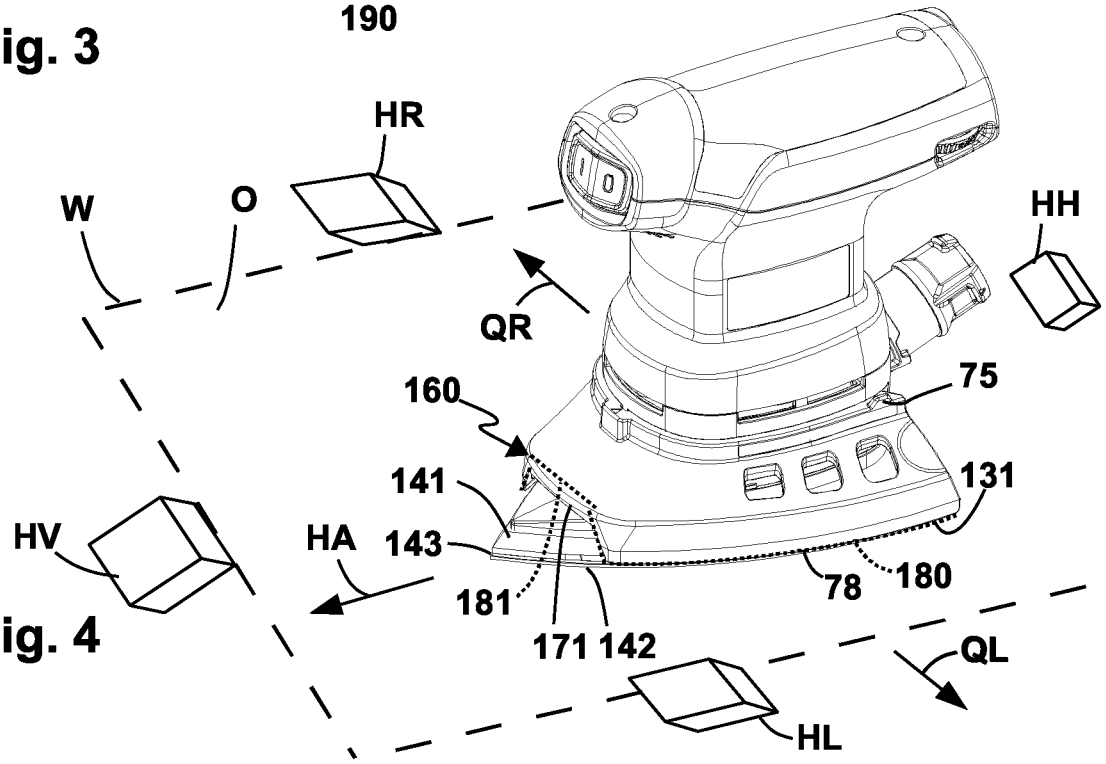
FIG. 4 shows the arrangement according to FIG. 3, wherein the covering device is arranged on the portable machine tool.
Figure 5:
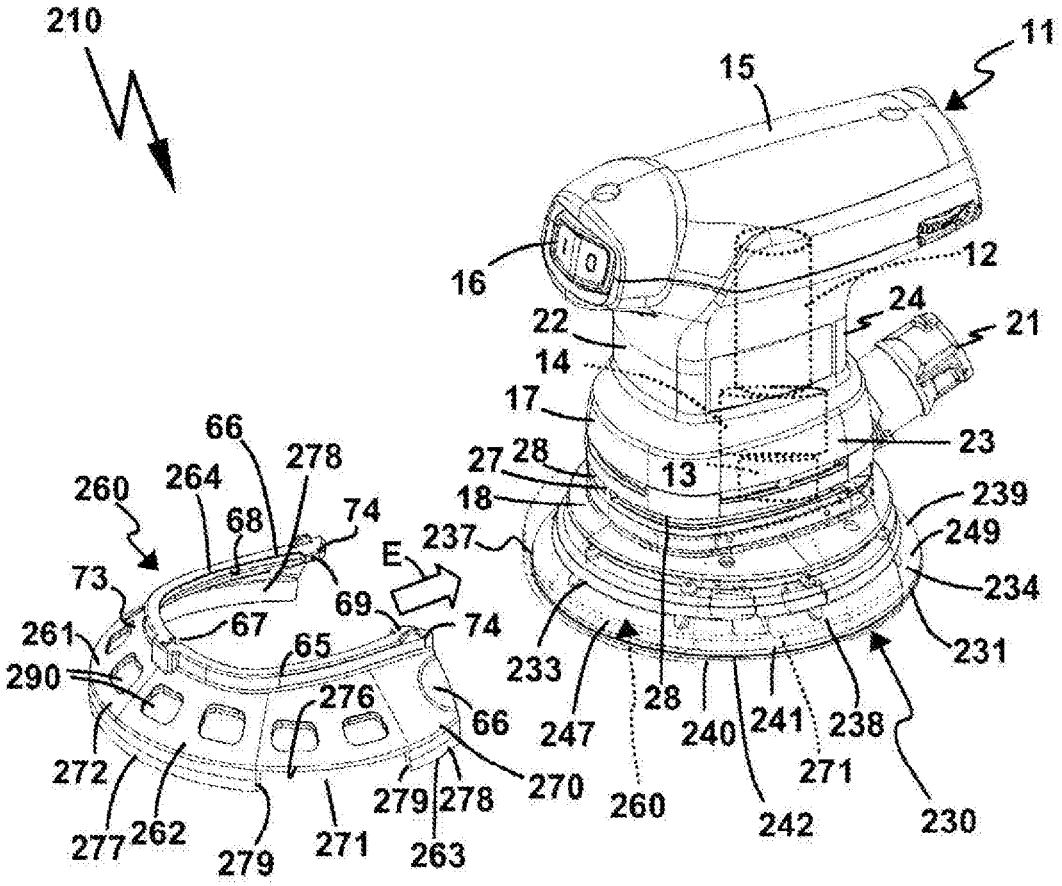
FIG. 5 shows the portable machine tool according to the above Figures with another covering device in a state separated from each other.

A similar situation arises with a portable machine tool 110 according to FIGS. 3 and 4 which in place of the disc tool 30 has a triangular disc tool 130. The disc tool 130 has, for example, a substantially triangular processing face 131 and a similarly substantially triangular carrier plate 133 on which a triangular cushion 134 is retained. With a portable machine tool 210 according to FIGS. 5 and 6 with a round disc tool 230, a similar problem also arises in that the respective disc tool 130, 230 tangentially collides with obstacles and is thereby damaged itself or damages the obstacle HV, HR or HL or both.

Both a portion 137 which protrudes forwards and lateral portions 138 and a rear portion 139 protrude in front of the projection of the machine housing 11 onto the workpiece surface O and are thus exposed. The protruding portion 137 forms a tip 143 or a tip region 141 which in a state exposed forwards in the direction of the main working direction HA protrudes in front of the machine housing 11 or the front side 22 thereof. From the tip region 141, side faces 248 of the disc tool 130 extend to the rear portion 139 on which a rear, end-side side face 149 is provided. The side faces 148, 149 may in contact with obstacles which protrude, for example, in front of the workpiece surface O, readily become damaged.

The disc tool 230 has a substantially round, circular outer contour and processing face 231. Also round, in particular circular, are a carrier plate 233 of the processing tool or disc tool 230 and a cushion 234 which is arranged on the carrier plate 233. Although the disc tool 230 is somewhat more compact than the disc tools 30, 130, it is completely exposed with respect to the machine housing 11 and in particular in the event of edge-side processing of the workpiece surface O at risk by obstacles which protrude upwards at that location.

The disc tool 230 protrudes, for example, forwards, with a front portion 237 in front of a front side 22 of the machine housing 11. To the side the disc tool 230 also protrudes in a manner of speaking laterally in front of the transverse sides 23 of the machine housing 11, that is to say, with lateral portions 238. A rear portion 239 which protrudes in front of the rear side 24 of the machine housing or the outer peripheral contour 20 is in contrast arranged substantially below the extraction connection 21 so as to be protected. Nonetheless, at least the lateral and front portions 238, 237 of the disc tool 230 are also exposed and at risk of striking obstacles, wherein, on the one hand, the disc tool 230, on the other hand, the obstacle HV, HR or HI may become damaged.

In order to overcome these problems, there are provided covering devices 60, 160, 260 which if necessary can be secured to the machine housing 11 in order to cover the disc tool 30, 130, 230.

The covering devices 60, 160, 260 have base members 61, 161, 261, which each have a base member 62, 162, 262 from which side members 63, 163, 263 and 64, 164, 264 protrude and thus define a receiving member 65 in which the machine housing 11 can be in a manner of speaking inserted or—in other words—with which the covering device 60, 160, 260 can be fitted to the machine housing 11 in an insertion direction E. The side members 63, 163, 263 and 64, 164, 264 are then in abutment with the transverse sides 23 and the base members 62, 162, 262 at the front side 22 of the machine housing 11. A plug type connection is thereby possible between the covering devices 60, 160, 260 and the machine housing 11.

On the outer peripheral contour 20 of the machine housing 11 there is provided a plug-type receiving member 26 as a component of securing means 25 which serves to receive plug-type projections 66 which are formed by the side members 63, 163, 263 and 64, 164, 264.

The covering devices 60, 160, 260 are configured in the manner of clamps 85 which can be fitted in a clamp-like manner to the machine housing 11.

For a central centering of the covering devices 60, 160, 260 on the machine housing 11, there are, for example, provided positive-locking contours 67, for example, positive-locking receiving members, on the base members 62, 162, 262 which in the state in which the covering devices 60, 160, 260 are fitted to the machine housing 11, are in engagement with positive-locking counter-contours 27 at the front side 22 of the machine housing 11.

The plug type connection between the machine housing 11 and covering device 60, 160, 260 comprises guiding receiving members 28 which are provided on the machine housing 11 and into which guiding contours 68 which protrude inwards in the direction towards the receiving member 65 protrude. The guiding contours 68 engage in a positive-locking manner in the guiding receiving members 28 when the respective covering device 60, 160, 260 is fitted to the machine housing 11. Consequently, the covering devices 60, 160, 260 are retained in a positive-locking manner transversely relative to the insertion direction E.

A retention with respect to the insertion direction E is ensured by an engagement with locking means which have locking projections 69 on the free end regions of the lateral members 63, 163, 263 and 64, 164, 264 which engage in locking receiving members 29 at the transverse sides 23 of the machine housing 11 or at the longitudinal end regions of the guiding receiving members 28 when the respective covering device 60, 160, 260 is fitted to the machine housing 11. In this instance, it is advantageous for the lateral members 63, 163, 263 and 64, 164, 264 to be able to be redirected in a direction away from each other or in a direction for widening the receiving member 65 in a flexible or resilient manner and, when the locking projections 69 are opposite the locking receiving members 29, to move towards each other again.

An introduction of the locking projections 69 of the covering devices 60, 160, 260 in the plug type receiving member 26 is facilitated by inclined introduction members 74 which are provided at the free end regions of the lateral members 63, 163, 263. A release of the catch projections 69 is advantageously facilitated by means of gripping elements 75 which are provided in the region of the catch projections 69 on the lateral members 63, 163, 263 and 64, 164, 264.

Consequently, a simple assembly of the covering devices 60, 160, 260 on the machine housing 11 is possible. They can thus be readily removed when they are not required, but may also remain a relatively long time on the machine housing 11 since an edge-side processing of the workpiece surface O is also possible with a covering device 60, 160, 260 which is mounted on the machine housing 11.

The covering device 60 has a covering wall 70 which with a covering portion 72 covers the carrier plate 33 from the side of the machine housing 11, in the drawing from above, and additionally has protection walls 77, 78 which can also be referred to as protection wall portions. On the covering portion 72, there is provided a wall region 73 which protrudes in the manner of a collar and which delimits the receiving member 65.

The protection wall 77 is arranged upstream of the side face 47 of the disc tool 30, that is to say, upstream in the main working direction HA of the side face 47 so that it protects it from frontal contact with the obstacle HV. The protection walls 78 are arranged upstream of the side faces 48 with respect to the transverse working directions QR and QL so that they can protect the disc tool 30 from contact with the lateral obstacles HR and HL.

Nonetheless, an edge-side processing of the workpiece surface O is readily possible. Between the protection walls 77, 78 there is provided a recess 71 through which a corner region 41 of the disc tool 30 in front of an outer peripheral contour 80 which in the region of the recesses 71 is not rectangular but instead has corresponding recesses or indentations 81 in which the processing face 31 is provided in a manner of speaking free and without any covering towards the side for an edge-side processing of the workpiece surface O. In the corner regions 41, a side edge region 42 of the processing face 31 is free as far as the side face 47 and side face 48 without a front-side covering by the covering device 60 so that the disc tool 30 with the corner regions 41 can be brought up to, in an extreme case, direct contact with the obstacle HV or to the side with the obstacles HR and HL. However, the operator will generally attempt to process the workpiece surface O with the processing face 31 in the corner regions 41 without such direct contact with the obstacles HV, HR and HL occurring.

Furthermore, a rear region of the processing face 31 in the main working direction HA is freestanding, that is to say, in the rear portion 39. It is not covered by the covering device 60 so that per se the rear side face 49 is ready for an edge-side processing of the workpiece surface O. However, it can be seen that the portion of the handle portion 15 which protrudes backwards over the rear side 24 of the machine housing 11 and the extraction connection 21 located therebelow, in this instance an extraction pipe, impede operation at the rear.

The recesses 71 have narrow side walls 79 which extend from the protection walls 77, 78 as far as the covering portion 72 and between which a narrow side wall 76 extends on the covering portion 72. From above, therefore, even the carrier plate 33 in the corner regions 41 can be seen and consequently also the processing face 31 which extends with the same surface extent.

The covering device 160 of the portable machine tool 110 has a substantially triangular outer peripheral contour 180 in which an indentation 181 is provided in the tip region 141. Consequently, the tip 143 protrudes freely in front of the covering device 160 so that portions of the side faces 148 which are located in the region of the indentation 181 and consequently the side edges of these portions of the side faces 148 beside the processing face 131 are ready and free for an edge-side or corner processing operation of the workpiece surface O.

Also the rear portion 133, in any case the rear side face 49 and the side edge of the processing face 131 at that location are free, that is to say, are not covered by the covering device 160 so that the rear portion 133 of the disc tool 130 is ready for an edge-side processing operation of the workpiece surface O.

The base member 161 of the covering device 60 has a covering portion 172 which covers the disc tool 30 with the exception of a recess 171 in the region of the tip 143 or the tip region 141. Protection walls 178 which protrude downwards from the covering portion 172 in front of the side faces 143 substantially cover the side faces 148 with the exception of the tip region 141. Consequently, an edge protection or side impact protection is provided there for the sensitive disc tool 130 or the sensitive obstacles HL, HR and HV which could potentially be damaged by the disc tool. However, a front-side cover, for example, in the manner of the side wall 77 of the covering device 60 is not present.

In the recess 171 a side edge region 142 of the disc tool 130 protrudes freely in front of the outer peripheral contour 180.

The recess 171 has narrow side walls 179 in the region of the protection walls 178 and a narrow side wall 176, where it adjoins the covering portion 172.

Furthermore, there are advantageously provided through-openings 190, through which, for example, the carrier plate 133 or the disc tool 130 can be seen from above. The through-openings 190 may, however, also be used to allow the selective influx of external air which is extracted at the extraction connection 21.

The covering device 260 leaves a rear portion 239 of the disc tool 260 free. The lateral portions 238 and the front portion 239 are, however, substantially covered by the covering device 260. On the base member 261 thereof, in particular a covering portion 272, influx openings 290 are provided, for example, for the influx of external air or for better visibility of the disc tool 330. In front of the covering portion 271 there protrudes a front protection wall 277 of the covering device 260 which covers the front portion 237 of the disc tool 230. Between the front protection wall 277 and protection walls 278 which partially cover the side faces 248 of the disc tool 230, there are provided recesses 271 through which a side edge region 242 of the disc tool 230 and consequently the processing surface 231 freely protrudes. Consequently, with an edge portion 241 of the disc tool 230 which is arranged in one of the recesses 271, the workpiece surface O can be processed at the edge side, for example, in the region of the obstacles HR or HL.

The recesses 271 (only one recess 271 could also be provided, in one of the side members 263 or 264) have, for example, narrow side walls 279 in the region of the protection walls 277, 278 between which a narrow side wall 276 extends along the covering portion 272.

Figure 6:
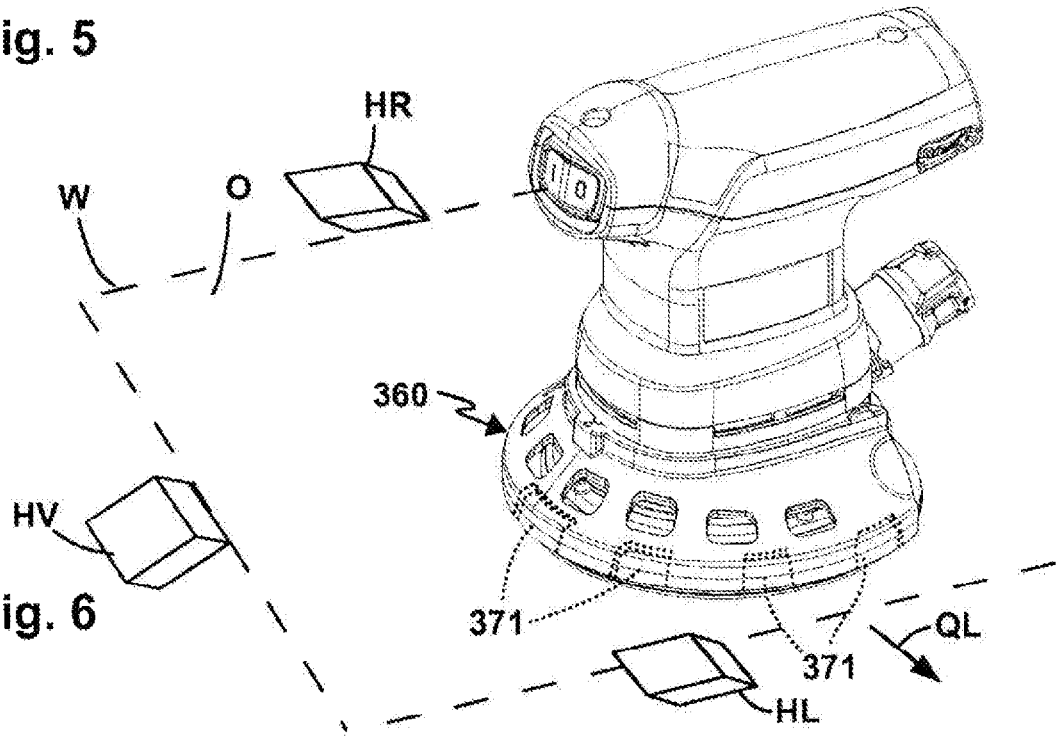
FIG. 6 shows the portable machine tool according to FIG. 5 with the covering device arranged thereon.

In FIG. 6, another embodiment of an alternative of the covering device 260 is illustrated, that is to say, a covering device 360. This has, for example, a plurality of recesses 371 which are angularly spaced apart over the outer periphery thereof and through which in a manner not described in greater detail edge regions of the disc tool 230 protrude freely in front of the outer peripheral contour of this covering device 360.

The invention claimed is:

1. A portable machine tool having a pad tool and a drive motor, which is arranged in a machine housing for driving the pad tool to produce an oscillating or rotating or eccentric movement of a processing face of the pad tool, wherein the portable machine tool can be guided with the processing face forwards in a main working direction and laterally transversely relative to the main working direction in at least one transverse working direction for a grinding or polishing operation of a workpiece surface, wherein the machine housing has a front side facing forwards in the main working direction and a rear side opposite the front side, the rear side having at least one of an extraction connection for extracting particles generated by the pad tool or a handle portion to be gripped with a hand, the extraction connection or the handle portion protruding from the rear side of the machine housing in a direction opposite the main working direction, wherein the portable machine tool has, for the pad tool, a covering device, which has at least one protection wall which is arranged upstream of at least one side face of the pad tool which extends beside the processing face with respect to the main working direction or the at least one transverse working direction in order to protect against contact with obstacles, wherein the at least one protection wall of the covering device completely or substantially covers side flanks of the pad tool, and wherein the covering device is a one-piece clamp, the clamp comprising a base member and two lateral members extending rearwardly from the base member, the two lateral members clamping the machine housing at mutually opposing sides, and wherein the base member comprises a positive locking contour, and wherein the front side of the machine housing comprises a plug-type receiving member for receiving the positive locking contour of the covering device base member for releasably securing the covering device to the center of the machine housing without application of a tool to the covering device, and wherein the covering device is attachable to and removable from the machine housing without removing the pad tool, and wherein the processing face of the pad tool is substantially rectangular and has a front portion extending from the front side of the housing, the front portion having a front end with two corners, and wherein the at least one protection wall of the covering device comprises a base member portion extending from the base member of the covering device and two lateral member portions extending respectively from the two lateral members of the covering device, the base member portion covering a portion of the front portion of the rectangular processing face and each of the two lateral member portions covering a portion of a respective one of the side flanks of the pad tool, and wherein at least one recess is formed between the base member portion of the protection wall and one of the two lateral member portions of the protection wall, at least one of the two corners of the front end of the processing face protruding through the at least one recess for an edge-side processing operation of the workpiece surface.

2. The portable machine tool according to claim 1, wherein the pad tool protrudes freely counter to the main working direction backwards through a free portion of the covering device or the covering device does not cover a rear portion of the pad tool with respect to the main working direction.

3. The portable machine tool according to claim 1, wherein, on the lateral members of the clamp, locking means for engagement with the machine housing are provided, and wherein the lateral members for securing to the machine housing can be redirected away from each other.

4. The portable machine tool according to claim 1, wherein a gear mechanism for producing the drive movement of the pad tool is arranged between the drive motor and the pad tool.

5. The portable machine tool according to claim 4, wherein the gear mechanism can be switched between at least two of movement types or produces exclusively a rotating movement of the pad tool through a maximum of 30° about a fixed or non-fixed rotation axis.

6. The portable machine tool according to claim 1, wherein the at least one protection wall covers the pad tool with respect to the main working direction and forms the foremost portion of the portable machine tool with respect to the main working direction.

7. The portable machine tool according to claim 1, wherein the at least one protection wall of the covering device has a frontally covering portion arranged between the two corners of the front end of the processing face which protrude in each case through a recess in front of the outer peripheral contour of the covering device.

8. The portable machine tool according to claim 1, wherein the pad tool comprises a carrier plate which is driven by the drive motor.

9. The portable machine tool according to claim 8, wherein the carrier plate has a retention face, the pad tool being secured to the retention face for securing a grinding means or a polishing means thereto.

10. The portable machine tool according to claim 1, wherein the machine housing does not protrude in front of an outer peripheral contour of the covering device or the processing face of the pad tool in the main working direction or the at least one transverse direction.

11. The portable machine tool according to claim 1, wherein a handle element is securely connected to the machine housing or is integral with the machine housing or is arranged in an articulated manner on the machine housing using an articulation arrangement.

12. The portable machine tool according to claim 1, wherein the at least one recess forms a single recess of the covering device.

13. The portable machine tool according to claim 1, wherein the covering device has an arrangement with at least two or more recesses which are arranged beside each other in a row direction or wherein the covering device has exclusively recesses with respect to the transverse working directions.

14. The portable machine tool according to claim 1, wherein the covering device has at least one through-opening or an arrangement of a plurality of through-openings through which a carrier plate of the pad tool can be seen or which are used for the influx of external air at an extraction connection of the portable machine tool.

15. The portable machine tool according to claim 1, wherein the at least one protection wall of the covering device covers the pad tool laterally with respect to the main working direction or with respect to the at least one transverse working direction and does not cover it at the rear.

16. The portable machine tool according to claim 1, wherein the geometry of the envelope or the outer peripheral contour of the covering device, with the exception of in the region of the at least one recess, corresponds to the geometry of the outer peripheral contour of the processing face of the pad tool.

17. The portable machine tool according to claim 1, wherein the geometry of the envelope or the outer peripheral contour of the covering device, with the exception of in the region of the at least one recess, is substantially triangular or rectangular, or circular.

18. The portable machine tool as defined in claim 1, wherein the two lateral member portions of the protection wall extend from the base member portion of the protection wall at an angle of about 90 degrees.

19. The portable machine tool as defined in claim 1, wherein the at least one recess is disposed adjacent the front side of the machine housing opposite the at least one of the extraction connection or the handle portion.

20. A portable machine tool having a pad tool and a drive motor, which is arranged in a machine housing for driving the pad tool to produce an oscillating or rotating or eccentric movement of a processing face of the pad tool, wherein the portable machine tool can be guided with the processing face forwards in a main working direction and laterally transversely relative to the main working direction in at least one transverse working direction for a grinding or polishing operation of a workpiece surface, wherein the machine housing has a front side facing forwards in the main working direction and a rear side opposite the front side, the rear side having at least one of an extraction connection for extracting particles generated by the pad tool or a handle portion to be gripped with a hand, the extraction connection or the handle portion protruding from the rear side of the machine housing in a direction opposite the main working direction, wherein the portable machine tool has, for the pad tool, a covering device, which has at least one protection wall which is arranged upstream of at least one side face of the pad tool which extends beside the processing face with respect to the main working direction or the at least one transverse working direction in order to protect against contact with obstacles, wherein the at least one protection wall of the covering device completely or substantially covers side flanks of the pad tool, and wherein the covering device is a one-piece clamp, the clamp comprising a base member and two lateral members extending rearwardly from the base member, the two lateral members clamping the machine housing at mutually opposing sides, and wherein each of the lateral members comprises a projection disposed at a free end thereof, the projection being received in a plug-type receiving member formed in the machine housing, and wherein the covering device is attachable to and removable from the machine housing without removing the pad tool, and wherein the processing face of the pad tool is substantially triangular and has a front portion extending from the front side of the housing, the front portion having a front end defined by a front tip, and wherein the at least one protection wall of the covering device comprises a base member portion extending from the base member of the covering device and two lateral member portions extending respectively from the two lateral members of the covering device, each of the two lateral member portions covering a portion of a respective one of the side flanks of the pad tool, and the base member portion having at least one recess through which the front tip of the front end of the processing face protrudes for an edge-side processing operation of the workpiece surface.

21. The portable machine tool according to claim 20, wherein the covering device is releasably secured to the machine housing using securing means.

22. The portable machine tool according to claim 21, wherein the pad tool, when the covering device is removed, is without covering of the entire outer periphery or side edge region thereof.

23. The portable machine tool according to claim 21, wherein the covering device can be secured to the machine housing or can be removed from the machine housing without application of a tool to the covering device.

24. The portable machine tool according to claim 20, wherein the at least one protection wall of the covering device completely or substantially covers side flanks of the pad tool or extends as far as the processing face.

25. The portable machine tool according to claim 20, wherein a gear mechanism is arranged between the drive motor and the pad tool, the gear mechanism producing an eccentric or an oscillating or a hypercycloid movement of the pad tool.

26. The portable machine tool according to claim 20, wherein the base member comprises a positive locking contour, and wherein a front side of the machine housing comprises a plug-type receiving member for receiving the positive locking contour of the covering device base member for releasably securing the covering device to the center of the machine housing without application of a tool to the covering device.

27. The portable machine tool according to claim 20, wherein each of the lateral members of the covering device further comprises an inwardly directed guiding contour extending from the base member to the projection of each of the lateral members, each of the inwardly directed contours being received in a guiding receiving member formed in the machine housing.

28. The portable machine tool according to claim 20, wherein the lateral members are configured to be resiliently movable toward and away from each other.

29. The portable machine tool according to claim 28, wherein each of the lateral member projections comprises an inwardly directed locking projection having an inclined introduction member.

30. The portable machine tool as defined in claim 20, wherein the two lateral member portions of the protection wall extend from the base member portion of the protection wall at an angle of more than 90 degrees.

31. The portable machine tool as defined in claim 20, wherein the at least one recess is disposed adjacent the front side of the machine housing opposite the at least one of the extraction connection or the handle portion.

32. A portable machine tool having a pad tool and a drive motor, which is arranged in a machine housing for driving the pad tool to produce an oscillating or rotating or eccentric movement of a processing face of the pad tool, wherein the portable machine tool can be guided with the processing face forwards in a main working direction and laterally transversely relative to the main working direction in at least one transverse working direction for a grinding or polishing operation of a workpiece surface, wherein the machine housing has a front side facing forwards in the main working direction and a rear side opposite the front side, the rear side having at least one of an extraction connection for extracting particles generated by the pad tool or a handle portion to be gripped with a hand, the extraction connection or the handle portion protruding from the rear side of the machine housing in a direction opposite the main working direction, wherein the portable machine tool has, for the pad tool, a covering device, which has at least one protection wall which is arranged upstream of at least one side face of the pad tool which extends beside the processing face with respect to the main working direction or the at least one transverse working direction in order to protect against contact with obstacles, wherein the at least one protection wall of the covering device completely or substantially covers side flanks of the pad tool, wherein the covering device is a clamp, the clamp comprising a base member and two lateral members extending rearwardly from the base member, the two lateral members clamping the machine housing at mutually opposing sides, and wherein the covering device is attachable to and removable from the machine housing without removing the pad tool, and wherein the processing face is substantially triangular or rectangular and has a front portion extending from the front side of the housing, the front portion having a front end with at least one corner region, and wherein the at least one protection wall of the covering device comprises a base member portion extending from the base member of the covering device and two lateral member portions extending respectively from the two lateral members of the covering device, the two lateral member portions covering a portion of a respective one of the side flanks of the pad tool, and the base member portion having at least one recess through which at least one of the at least one corner region of the front end of the processing face protrudes for an edge-side processing operation of the workpiece surface.

33. The portable machine tool according to claim 32, wherein the base member comprises a positive locking contour, and wherein the front side of the machine housing comprises a plug-type positive locking receiving member for receiving the positive locking contour of the covering device base member for releasably securing the covering device to the center of the machine housing without application of a tool to the covering device, and wherein each of the lateral members comprises a projection disposed at a free end thereof, the projection being received in a guiding projection receiving member formed in the machine housing.

34. The portable machine tool according to claim 32, wherein the covering device is a one-piece clamp.

35. The portable machine tool as defined in claim 32, wherein the at least one recess is disposed adjacent the front side of the machine housing opposite the at least one of the extraction connection or the handle portion.

* * * * *